United States Patent [19]

Obara

[11] Patent Number: 4,984,692

[45] Date of Patent: Jan. 15, 1991

[54] OPTICAL CHARACTER READING APPARATUS WITH SORTER

[75] Inventor: Tadashi Obara, Hamura, Japan

[73] Assignee: Kabushiki Kaisha Toshiba, Kawasaki, Japan

[21] Appl. No.: 381,861

[22] Filed: Jul. 19, 1989

[30] Foreign Application Priority Data

Jul. 19, 1988 [JP] Japan ..... 63-179684

[51] Int. Cl.[5] ..... B07C 5/36; B65H 39/11

[52] U.S. Cl. ..... 209/583; 209/534; 209/900; 271/290; 271/273

[58] Field of Search ..... 209/548, 583, 584, 552, 209/534, 900, 656, 539, 540; 271/289, 290, 273, 274

[56] References Cited

U.S. PATENT DOCUMENTS

| | | | |
|---|---|---|---|
| 3,411,771 | 11/1968 | Bahr et al. | 271/273 |
| 3,709,480 | 1/1973 | Schulze et al. | 271/290 |
| 3,791,515 | 2/1974 | Wood | 209/900 X |
| 3,889,811 | 6/1975 | Yoshimura | 209/900 X |
| 3,973,769 | 8/1976 | Cross et al. | 271/289 |
| 4,285,508 | 8/1981 | Kaneko | 271/290 X |
| 4,299,382 | 11/1981 | Ichikawa | 271/273 X |
| 4,445,680 | 5/1984 | Kikuchi et al. | 271/290 |
| 4,449,706 | 5/1984 | Snellman et al. | 271/290 |

*Primary Examiner*—Donald T. Hajec

*Attorney, Agent, or Firm*—Oblon, Spivak, McClelland, Maier & Neustadt

[57] ABSTRACT

An optical character reading apparatus includes a scanner section and a sorter section each having an independent housing. The housing of the scanner section has a rear wall and a discharge port at the upper end portion of the rear wall through which slips read by means of reading means are discharged from the scanner section. The housing of the sorter section has a rear wall adjacently facing the rear wall of the housing of the scanner section, a front wall facing the rear wall, and a top wall, and a supply port is formed at the upper end portion of the rear wall so as to communicate with the discharge port of the scanner section. First and second passages are formed inside the housing of the sorter section. The first passage extends from the supply port to the region near the front wall, along the top wall. The second passage extends along the front wall so as to be continuous with the first passage. The slips fed through the supply port into the sorter section are guided to slip receiving portions by the first and second passages.

14 Claims, 4 Drawing Sheets

OPTICAL CHARACTER READING APPARATUS WITH SORTER

BACKGROUND OF THE INVENTION

1. Field of the Invention

The present invention relates to an optical character reading apparatus with a sorter mechanism capable of random sorting of read slips.

2. Description of the Related Art

Recently has been provided an optical character reading apparatus (OCR) which is provided with a sorter mechanism for randomly sorting read slips in accordance with read results. In the conventional apparatus of this type, a stand-alone sorter mechanism is mechanically connected to a scanner mechanism.

In sorting slips read by means of the scanner mechanism, in the conventional apparatus described above, the slips discharged from the scanner mechanism are transported through first, second, and third transfer paths, and are delivered from the third path into desired pockets of the sorter mechanism. The first path extends between the scanner mechanism and the sorter mechanism to the bottom of the sorter mechanism, the second path extends along the bottom of the sorter mechanism to the front face of the sorter mechanism, and the third path extends upward along the front face of the sorter mechanism.

The apparatus with the aforementioned construction, however, has the following drawbacks. The transfer paths for the slips extend so as to surround the sorter mechanism, thus entailing a long transportation distance. Accordingly, the slips are very liable to jam in the transfer paths. Moreover, the transfer paths extend through relatively narrow regions, such as the spaces between the sorter mechanism and the scanner mechanism and between the sorter mechanism and a floor, which are not externally accessible. Thus, maintenance work for the transfer paths and removal of jammed slips from the paths cannot be smoothly effected.

At the time of maintenance of the apparatus, the scanner mechanism and the sorter mechanism sometimes must be separated from each other. In the conventional apparatus, however, these two mechanisms are firmly connected by means of coupling members, and the sorter mechanism generally is as heavy as several hundred kilograms. It is very difficult, therefore, to separate the two mechanisms. Moreover, the sorter mechanism and the scanner mechanism are adjusted to the same height by means of separate jack means. In connecting these mechanisms again after the separation, therefore, their height must be readjusted. Thus, the maintenance work for the conventional apparatus requires a lot of time, and is not very efficient.

SUMMARY OF THE INVENTION

The present invention has been contrived in consideration of these circumstances, and its object is to provide an optical character reading apparatus, in which a transfer path for slips is so short that the frequency of occurrence of trouble can be lowered, and maintenance work is easy.

In order to achieve the above object, an apparatus according to the present invention comprises a scanner section and a sorter section each having an independent housing. The housing of the scanner section has a rear wall and a discharge port at the upper end portion of the rear wall through which slips read by means of reading means are discharged from the scanner section. The housing of the sorter section has a rear wall adjacently facing the rear wall of the housing of the scanner section, a front wall facing the rear wall, and a top wall, and a supply port is formed at the upper end portion of the rear wall so as to communicate with the discharge port of the scanner section. First and second passages are formed inside the housing of the sorter section. The first passage extends from the supply port to the region near the front wall, along the top wall. The second passage extends along the front wall so as to be continuous with the first passage. The slips fed through the supply port into the sorter section are guided to slip receiving portions by the first and second passages.

The apparatus of the present invention further comprises supporting means for supporting one of the respective housings of the scanner section and the sorter section for movement relative to the other housing, in the direction perpendicular to the rear wall. Thus, these two housings can be easily separated from each other.

BRIEF DESCRIPTION OF THE DRAWINGS

FIGS. 1 to 7 show an optical character reading apparatus according to an embodiment of the present invention, in which:

FIG. 1 is a front view of the apparatus;

FIG. 2 is a plan view of the apparatus;

FIG. 3 is a left side view of the apparatus;

FIG. 4 is a right side view of the apparatus;

FIG. 5 is a perspective view of the apparatus;

FIG. 6 is a front view schematically showing the interior of the apparatus; and

FIG. 7 is an enlarged view showing part of a scanner section.

DETAILED DESCRIPTION OF THE PREFERRED EMBODIMENT

Figure 2:
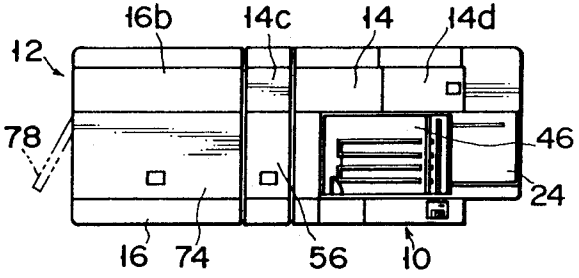

An embodiment of the present invention will now be described in detail with reference to the accompanying drawings.

As is shown in FIGS. 1 to 4, an optical character reading apparatus according to the embodiment of the present invention comprises scanner section 10 of a desk-top type for reading characters from slips, as objects to be scanned, and sorter section 12 for sorting the slips in accordance with the read results. Scanner section 10 includes substantially L-shaped housing 14, which contains a reading mechanism mentioned later. Sorter section 12 includes rectangular main housing 16, which contains a number of sorter pocket tables 18 and a sorter mechanism mentioned later. Tables 18 serve as a receiving section for receiving the read slips. Further, section 12 includes rectangular auxiliary housing 20, which contains control unit 22 for controlling the operation of the sorter mechanism. Scanner section 10 is mounted on auxiliary housing 20.

As is shown in FIGS. 1 to 6, housing 14 of scanner section 10 includes horizontal bottom wall **14*a*, vertical rear wall 14*b*, horizontal top wall 14*c*, and substantially L-shaped front cover 14*d*. Hopper stand 24 as a holding portion is attached to the right-hand end of the bottom portion of housing 14, and the slips are set on stand 24. Formed at the upper end portion of rear wall 14*b* is discharge port 26 through which the slips are discharged from scanner section 10. Formed inside housing 14 is transfer path 28 along which the slips taken out from hopper stand 24 are guided to discharge port 26**.

Path 28 includes first passage 28*a* extending horizontally from stand 24, second passage 28*b* extending upward from the first passage to the region near top wall 14*c*, along the front face of housing 14, and third passage 28*c* extending from the second passage to port 26, along top wall 14. The first and second passages 28 *a* and 28 *b* constitute a first section of the transfer path 28, and the third passage 28 *c* constitutes a second section of the path.

Arranged inside housing 14 are feed roller unit 30 and separation roller 32, which serve to deliver the slips one by one from hopper stand 24 into first passage 28*a*. Front cover 14*d* is provided with reading mechanism 34 for reading characters from the slips passing through first passage 28*a*. Mechanism 34 includes printed board 35 mounted with a CCD (not shown), optical lens 36 opposed to the CCD, lamp 37 used to apply reading light to the slips, and a plurality of mirrors 38 for guiding the reading light reflected by the slips to lens 36. Arranged in the vicinity of second passage 28*b* are numbering head 40 for numbering the read slips and platen roller 42 facing head 40.

Front cover 14*d* is fitted with movable pocket table 44 for receiving read slips, fixed pocket table 45 for receiving rejected slips, and fixed pocket table 45 for receiving slips subject to read errors. These three tables are arranged at intervals along second passage 28*b*. A pair of distribution gates 48 and gate 50, which serve to distribute the slips passing through passage 28*b* to tables 44, 45 and 46, respectively, are arranged successively along passage 28*b*, on the lower-course side of numbering head 40. Gate 50 at the lower-course end of second passage 28*b*, in particular, is shiftable between a first position indicated by full line and a second position indicated by two-dot chain line in FIG. 7. In the first position, gate 50 guides the slips, transported along second passage 28*b*, to third passage 28*c*. In the second position, gate 50 guides the slips to pocket table 46.

Figure 6:
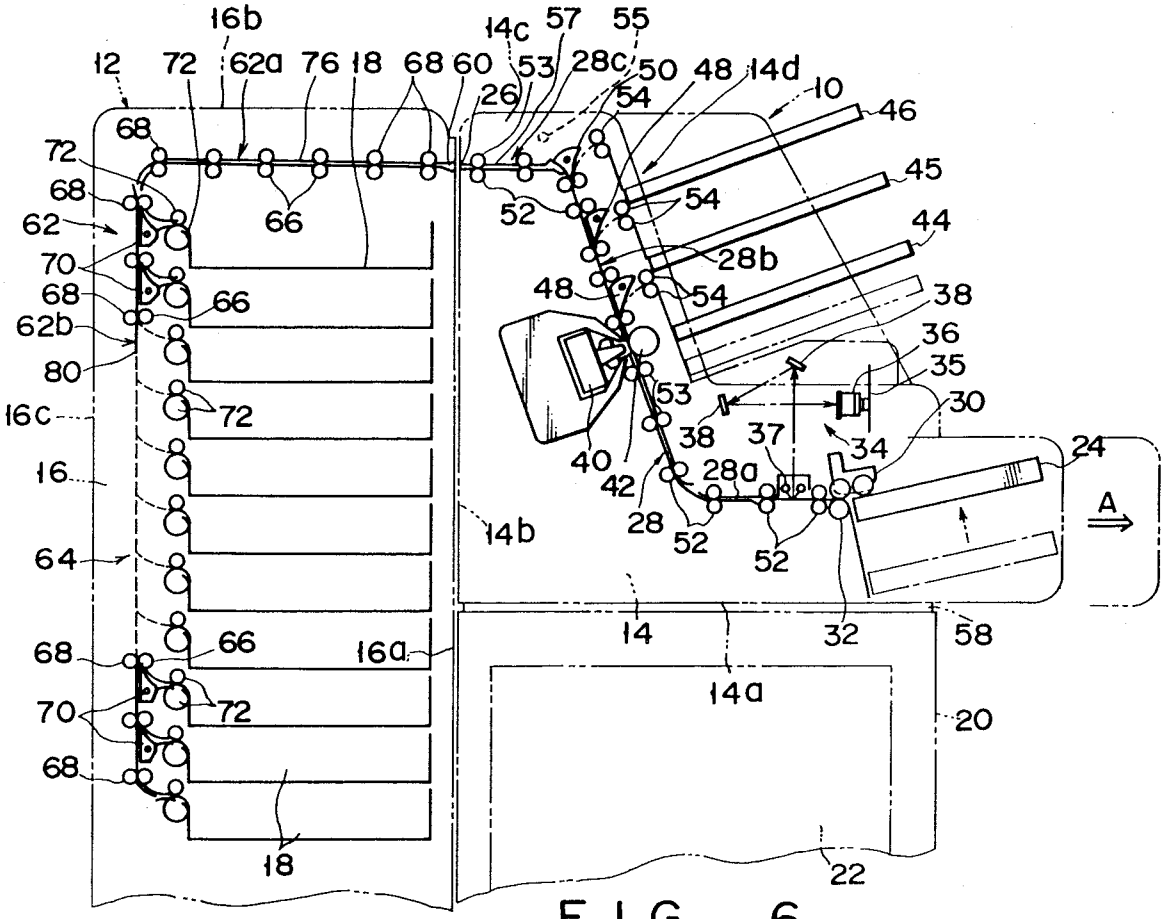
Figure 7:
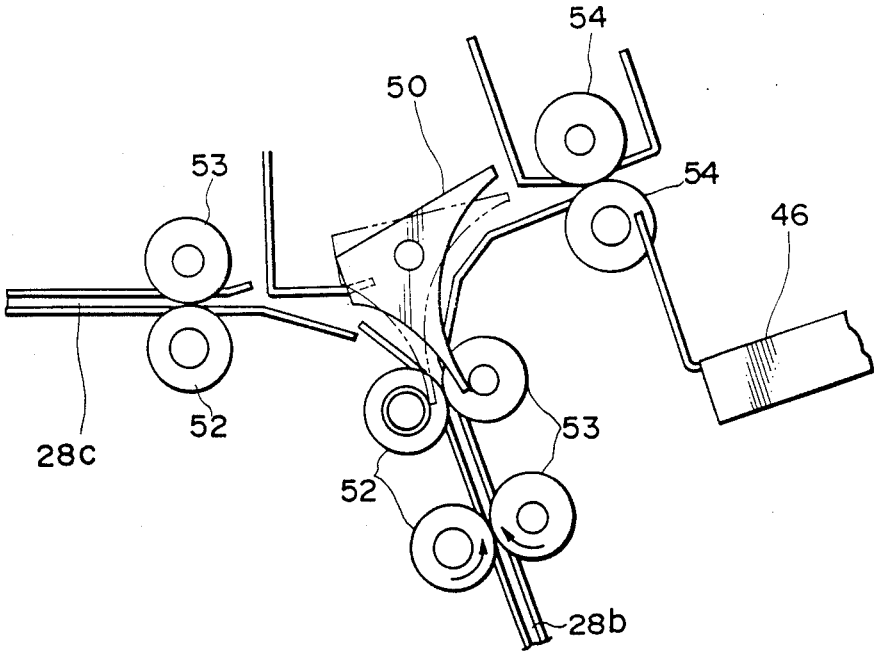

A number of drive rollers 52 are arranged along transfer path 28, on one side thereof. On the other side of path 28, a number of tension rollers 53 are arranged along the path so as to face rollers 52, individually. The slips taken out from hopper stand 24 are transported along transfer path 28 to table 44, 45 or 46 or discharge port 26 by means of rollers 52 and 53. In FIGS. 6 and 7, numeral 54 designates feed rollers for delivering the slips to table 44, 45 or 46.

Figure 1:
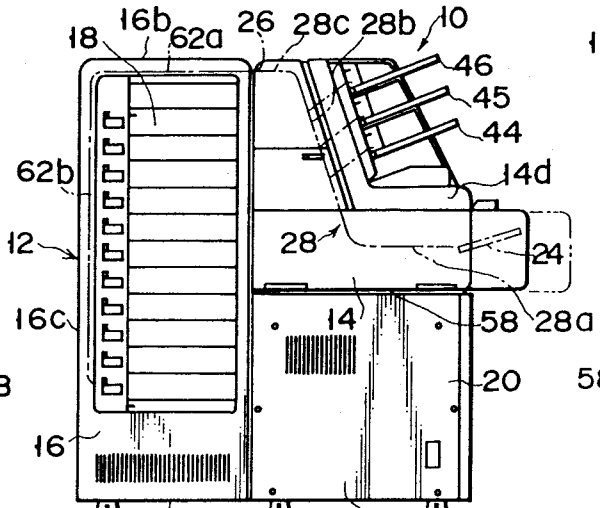
Figure 5:
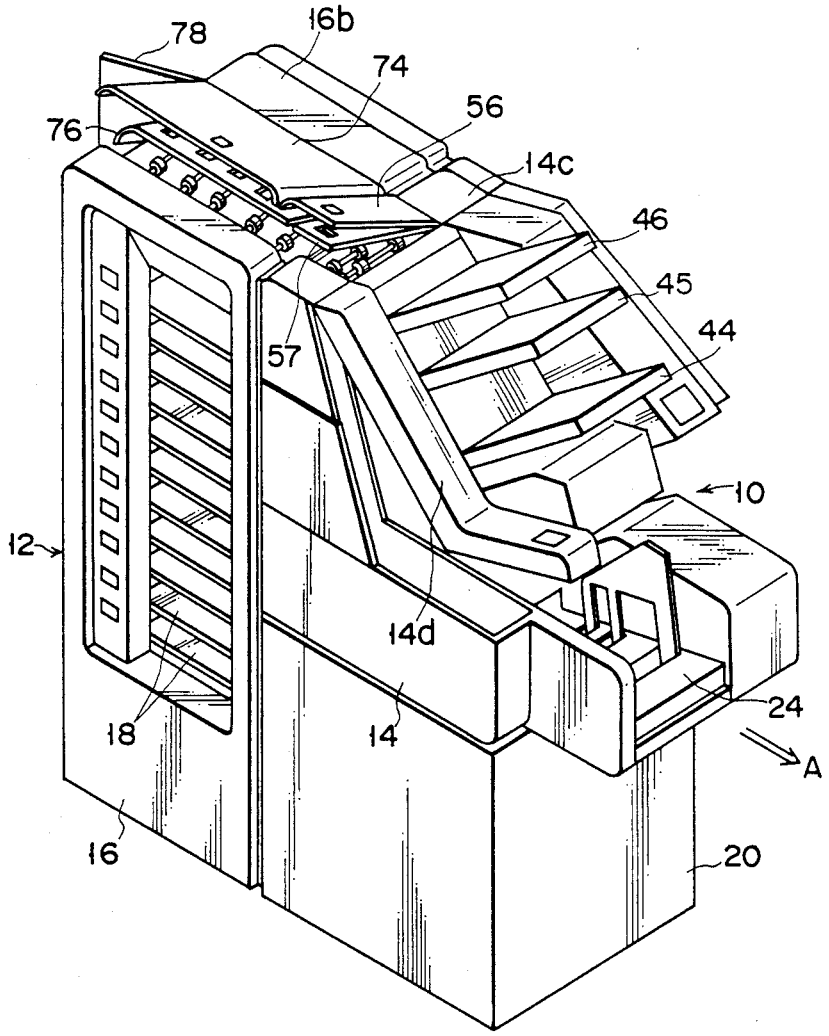

Front cover 14*d*, fitted with tables 44 to 46, is rockable around rotating shaft 55 at the upper end portion of housing 14, between a closed position shown in FIGS. 1 and 6 and an open position shown in FIG. 5. First and second passages 28*a* and 28*b* of transfer path 28 can be exposed to the outside by rocking cover 14*d* to wall 14*c* of housing 14 constitutes swingable lid 56. When lid 56 is lifted, guide plate 57 is also lifted, so that third passage 28*c* is exposed to the outside. When lid 56 is shut down, plate 57 moves to the position shown in FIG. 6, thereby defining passage 28*c*.

Scanner section 10, constructed in this manner, is mounted on a top wall of auxiliary housing 20 of sorter section 12 so that it can be slid thereon by means of slide mechanism 58. Thus, section 10 is supported by mechanism 58 so as to be slidable for a predetermined distance in the direction of arrow A perpendicular to rear wall 14*b* of housing 14. At the time of maintenance of the apparatus, for example, scanner section 10 can be slid away, in the direction of arrow A, from sorter section 12, so that the maintenance work can be started on the side of rear wall 14*b* of housing 14.

Meanwhile, sorter section 12 is constructed as follows.

As is shown in FIGS. 1 to 6, main housing 16 includes vertical rear wall 16*a* adjacently opposed to rear wall 14*b* of housing 14 of scanner section 10, horizontal top wall 16*b* flush with top wall 14*c* of housing 14, vertical front wall 16*c* opposed to rear wall 16*a*, and horizontal bottom wall 16*d* flush with a bottom wall of auxiliary housing 20. Arranged inside main housing 16 are a plurality of sorter pocket tables 18, e.g., 11 in number, which receive the read slips delivered from scanner section 10. Tables 18, which each extend horizontally, are arranged in the vertical direction. Supply port 60 is formed at the upper end portion of rear wall 16*a* of main housing 16 so as to face discharge port 26 of scanner section 10. Thus, the slips discharged from discharge port 26 is introduced into housing 16 through supply port 60. Arranged in main housing 16, moreover, are transfer path 62, through which the introduced slips are transported to pocket tables 18, and sorter mechanism 64 for distributing the delivered slips to desired tables 18.

Transfer path 62 includes first and second passages 62*a* and 62*b*. First passage 62*a* extends from supply port 60 to the region near front wall 16*c*, along top wall 16*b*, while second passage 62*b* extends from the terminal end of the first passage to the region near lowermost pocket table 18, along front wall 16*c*. A number of drive rollers 66 are arranged along transfer path 62, on one side thereof. On the other side of path 62, a number of tension rollers 68 are arranged along the path so as to face rollers 66, individually. The slips introduced through supply port 60 into main housing 16 are transported along transfer path 62 by means of rollers 66 and 68.

Sorter mechanism 64 includes distribution gates 70 and feed roller pairs 72, as many as pocket tables 18. Gates 70 are arranged along second passage 62*b* so as to be situated close to their corresponding tables 18. The slips transported through passage 62*b* are guided from passage 62*b* toward any of tables 18 by their corresponding gates 70, and are delivered to tables 18 by feed roller pairs 72.

Figure 3:
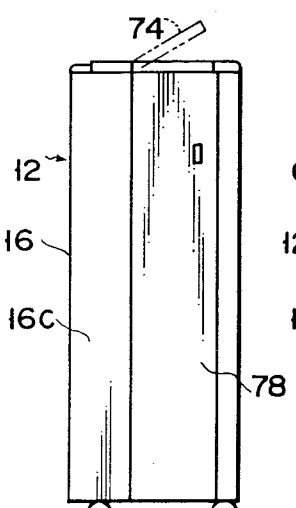
Figure 4:
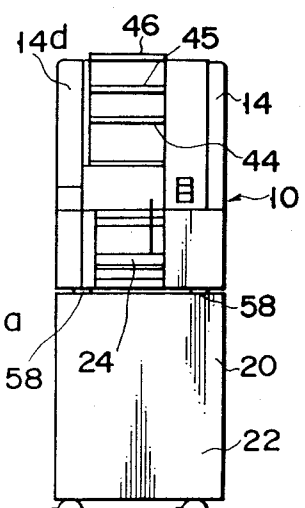

As seen from FIGS. 3 and 6, part of top wall 16*b* of main housing 16 constitutes swingable lid 74. When lid 74 is lifted, guide plate 76 is also lifted, so that first passage 62*a* is exposed to the outside. When lid 74 is shut down, plate 76 moves to the position shown in FIG. 6, thereby defining passage 62*a*. Likewise, as seen from FIGS. 2 and 6, part of front wall 16*c* of main housing 16 constitutes swingable lid 78. When lid 78 is lifted, guide plate 80 is also lifted, so that second passage 62*b* is exposed to the outside. When lid 78 is shut down, plate 80 moves to the position shown in FIG. 6, thereby defining passage 62*b*.

The following is a description of the operation of the apparatus constructed in this manner.

First, the slips on hopper stand 24 are taken out one by one by means of feed roller unit 30 and separation roller 32, and are fed into first passage 28*a* of transfer path 28. While the slips are being transported along passage 28*a*, information recorded on the slips are read by means of reading mechanism 34. Then, the read slips are transported through second passage 28*b*, and a number is printed on the reverse side of each slip by means of numbering head 40 in the course of the transportation. If no sorting operation is performed, normally read slips, among the slips transported past head 40, are guided to movable pocket table 44 to be stacked thereon, by first distribution gate 48. If any of the slips are rejected due to dog-ears or dislocation, they are delivered to fixed pocket table 45 by second gate 48. Those slips subject to read errors, if any, are delivered to fixed pocket table 46 by gate 50.

In sorting the read slips, gate 50 is rocked to the first position indicated by full line in FIG. 7. Thereupon, the slips, transported to the upper end of second passage **28*b* via numbering head 40, are guided to third passage 28*c* by gate 50. After passing through passage 28*c*, the slips are discharged from scanner section 10 through discharge port 26**.

The discharged slips are introduced through supply port 60 into main housing 16 of sorter section 12, and are further transported along first passage **62*a* of transfer path 62, over sorter pocket tables 18. Then, the slips are transported downward along front wall 16*c* of housing 16, inside second passage 62*b*. In the course of this transportation, one of distribution gates 70 selected in accordance with the read result for each slip is operated, so that the slip is delivered from passage 62*b* to pocket table 18 corresponding to the selected gate. Thus, a number of slips can be distributed to and stacked on various pocket tables 18** in accordance with the read results.

In case of the slips' jamming in transfer path 28 of scanner section 10, or in conducting maintenance and inspection work for section 10, path 28 is exposed by lifting front cover **14*d* and/or lid 56. Also, scanner section 10 can be subjected to maintenance and inspection from its rear wall side, by sliding section 10 in the direction of arrow A to separate rear wall 14*b* of section 10 from rear wall 16*a* of main housing 16 of sorter section 12**.

Likewise, in case of the slips' jamming in transfer path 62 of sorter section 12, or in conducting maintenance and inspection work for section 12, path 62 is exposed by lifting lid 74 and/or lid 78.

According to the optical character reading apparatus constructed in this manner, transfer path 62 of sorter section 12, which guides the slips discharged from scanner section 10 to desired pocket tables 18, extends only over and beside tables 18. Therefore, path 62 can be made much shorter than its counterpart of a conventional apparatus, so that the frequency of occurrence of trouble, such as the slips' jamming, in transfer path 62 can be lowered.

Moreover, transfer path 62 is formed along the wall surface facing a relatively wide space, that is, top and front walls **16*b* and 16*c* of main housing 16. Accordingly, path 62 can be exposed to the outside by lifting lids 74 and 78**, and a relatively wide operation area can be secured for the removal of the jammed slips or the maintenance and inspection work. Thus, various operations can be performed easily and quickly.

Also for scanner section 10, various operations can be performed easily and quickly by lifting front cover **14*d* and lid 56. Moreover, section 10 can be moved away from main housing 16 of sorter section 12, by means of slide mechanism 58 on auxiliary housing 20 of section 12. At the time of maintenance and inspection of scanner section 10, therefore, section 10 can be easily separated from sorter section 12. Thus, the maintenance and inspection work can be easily started also from the rear side of scanner section 10. After the end of the work, an operable state of the apparatus, in which discharge port 26 of scanner section 10 communicates with supply port 60 of sorter section 12, can be easily established by only moving the scanner section toward main housing 16** of the sorter section.

It is to be understood that the present invention is not limited to the embodiment described above, and that various changes and modifications may be effected therein by one skilled in the art without departing from the scope or spirit of the invention.

For example, it is necessary only that the scanner section and the sorter section be arranged for relative movement, and the sorter section, instead of the scanner section, may be supported so as to be movable by means of the slide mechanism.

What is claimed is:

1. An optical character reading apparatus comprising:

a scanner section including a first housing, and reading means arranged in the first housing, for reading characters from objects to be scanned, said first housing having a rear wall and a discharge port at and upper end portion of the rear wall through which objects read by the reading means are discharged from the first housing;

a sorter section including a second housing, a plurality of receiving portions in the second housing, a transfer path inside the second housing for guiding the objects discharged from the scanner section to the receiving portions, and means for distributing each discharged object from the scanner section to a desired one of the receiving portions, said second housing having a rear wall adjacently facing the rear wall of the first housing, a front wall, a top wall, and a supply port through which the objects discharged through the discharge port are introduced into the second housing, said supply port facing the discharge port of the first housing, said transfer path including a first passage extending from the supply port to the region near the front wall of the second housing, along the top wall of the second housing, and a second passage extending downward from the region near the top wall of the second housing, along the front wall of the second housing, so as to be continuous with the first passage, said receiving portions being arranged along the second passage;

said sorter section including an auxiliary housing having a rear wall adjacently facing the rear wall of the second housing and a top wall extending in a direction substantially perpendicular to the rear wall, said first housing of said scanner section having a bottom wall opposed to the top wall of the auxiliary housing; and a slide mechanism arranged on the top wall of the auxiliary housing and supporting the scanner section to be slidable relative to the rear wall of the auxiliary housing.

2. An apparatus according to claim 1, wherein said top wall of said second housing includes a first lid portion for allowing the first passage of the transfer path to be exposed to the outside, and said front wall of said second housing includes a second lid portion for allowing the second passage of the transfer path to be exposed to the outside.

3. An apparatus according to claim 2, wherein said first lid portion is attached to the second housing to be rockable between a closed position, in which the first lid portion closes the first passage, and an open position, in which the first lid portion allows the first passage to be exposed, and said second lid portion is attached to the second housing to be rockable between a closed position, in which the second lid portion closes the second passage, and an open position, in which the second lid portion allows the second passage to be exposed.

4. An apparatus according to claim 3, wherein said sorter section includes a first guide plate defining part of the first passage and a second guide plate defining part of the second passage, said first and second guide plates being rockable in association with the first and second lid portions, respectively.

5. An apparatus according to claim 1, wherein said receiving portions each extend horizontally, and are arranged at regular intervals along the second passage.

6. An apparatus according to claim 5, wherein said distributing means includes a plurality of distribution gates located between the receiving portions and the second passage and adapted individually to guide the objects from the second passage to the receiving portions corresponding thereto.

7. An apparatus according to claim 1, wherein said first housing of said scanner section includes a front wall and a top wall substantially flush with the top wall of the second housing, and said scanner section includes a holding portion located near the lower end portion of a front wall of the first housing and holding objects, and a transfer path for guiding the objects delivered from the holding portion to the discharge port.

8. An apparatus according to claim 7, wherein said transfer path of said scanner section includes a first section extending from the holding portion to the region near the top wall of the first housing, along the front wall of the first housing, and a second section extending from the extending end of the first passage to the discharge port, along the top wall of the first housing.

9. An apparatus according to claim 8, wherein said front wall of said first housing includes a front cover for allowing the first section of the transfer path of the scanner section to be exposed to the outside, and said top wall of said first housing includes a lid portion for allowing the second section of the transfer path of the scanner section to be exposed to the outside.

10. An apparatus according to claim 9, wherein said front cover is attached to the first housing to be rockable between a closed position, in which the front cover closes the first section, and an open position, in which the front cover allows the first passage to be exposed, and said lid portion is attached to the first housing to be rockable between a closed position, in which the lid portion closes the second section, and an open position, in which the lid portion allows the second passage to be exposed.

11. An apparatus according to claim 9, wherein said reading means is opposed to the first section, and said scanner section includes a plurality of receiving tables attached to the front cover, and a guide mechanism for guiding the read objects from the first section to any of the receiving tables in accordance with read conditions.

12. An apparatus according to claim 1, wherein said slide mechanism supports the scanner section to be slidable in a direction substantially perpendicular to the rear wall of the auxiliary housing.

13. An optical character reading apparatus comprising:

a scanner section including a first housing which has a rear wall, a top wall, and a front wall, a holding portion located near a lower end portion of the front wall and holding objects to be scanned, and reading means arranged in the first housing, for reading characters from the objects;

said first housing including a discharge port at an upper end portion of the rear wall through which objects read by the reading means are discharged from the first housing, a transfer path for guiding the objects delivered from the holding portion to the discharge port, the transfer path having a first section extending from the holding portion to the region near the top wall along the front wall and a second section extending from the first section to the discharge port along the top wall, said front wall having a front cover rockable between a closed position, in which the front cover closes the first section of the transfer path, and an open position, in which the front cover allows the first section to be exposed, said top wall having a lid portion rockable between a closed position, in which the lid portion closes the second section of the transfer path, and an open position, in which the lid portion allows the second section to be exposed, and said reading means opposing to the first section;

said scanner section including a plurality of receiving tables attached to the front cover, and a guide mechanism for guiding the read objects from the first section to any of the receiving tables in accordance with read conditions; and a sorter section including a second housing, a plurality of receiving portions in the second housing, a transfer path inside the second housing for guiding the objects discharged from the scanner section to the receiving portions, and means for distributing each discharged object from the scanner section to a desired one of the receiving portions, said second housing having a rear wall adjacently facing the rear wall of the first housing, a front wall, a top wall, and a supply port through which the objects discharged through the discharge port are introduced into the second housing, said supply port being formed in the rear wall of the second housing so as to face the discharge port of the first housing, said transfer path of the second housing including a first passage extending from the supply port to the region near the front wall of the second housing, along the top wall of the second housing, and a second passage extending downward from the region near the top wall of the second housing, along the front wall of the second housing, so as to be continuous with the first passage, said receiving portions being arranged along the second passage.

14. An optical character reading apparatus composing:

a scanner section including a first housing which has a rear wall, a top wall, and a front wall, a holding portion located near a lower end portion of the front wall and holding objects to be scanned and reading means arranged in the first housing, for reading characters from the objects;

said first housing including a discharge port at an upper end portion of the rear wall through which objects read by the reading means are discharged from the first housing, a transfer path for guiding the objects delivered from the holding portion to the discharge port, the transfer path having a first passage extending substantially horizontally from the holding portion along the front wall, a second passage extending from the first passage to the region near the top wall along the front wall, and a thrid passage extending substantially horizontally front the second passage to the discharge port along the top wall, said front wall having a front cover for allowing the first and second passage to be exposed to the outside, said top wall having a lid portion for allowing the third passage to be exposed to the outside, and said reading means being arranged to opposite the first passage so as to read characters from the objects passing through the first passage; and a sorter section including a second housing, a plurality of receiving portions in the second housing, a transfer path inside the second housing for guiding the objects discharged from the scanner sections to the receiving portions, and means for distributing each discharged object from the scanner section to a desired one of the receiving portions, said second housing having a rear wall adjacently facing the rear wall of the first housing, a front wall, a top wall and a supply port through which the objects discharged through the discharge port are introduced into the second housing, said supply port being formed in the rear wall of the second housing so as to face the discharge port of the first housing, said transfer path of the second housing including a first passage extending from the supply port to the region near the front wall of the second housing, along the top wall of the second housing, and a second passage extending downward from the region near the top wall of the second housing, along the front wall of the second housing, so as to be continuous with the first passage, said receiving portions being arranged along the second passage.

* * * * *